US012745885B2

(12) United States Patent
Yang et al.

(10) Patent No.: US 12,745,885 B2
(45) Date of Patent: Sep. 29, 2026

(54) CLEANING APPARATUS

(71) Applicant: Beijing Roborock Technology Co., Ltd., Beijing (CN)

(72) Inventors: Yunlong Yang, Beijing (CN); Liang Qiao, Beijing (CN); Lei Zhang, Beijing (CN)

(73) Assignee: Beijing Roborock Technology Co., Ltd., Beijing (CN)

( * ) Notice: Subject to any disclaimer, the term of this patent is extended or adjusted under 35 U.S.C. 154(b) by 293 days.

(21) Appl. No.: 18/569,770

(22) PCT Filed: Jun. 2, 2022

(86) PCT No.: PCT/CN2022/096916

§ 371 (c)(1),
(2) Date: Dec. 13, 2023

(87) PCT Pub. No.: WO2022/262593

PCT Pub. Date: Dec. 22, 2022

(65) Prior Publication Data

US 2024/0268618 A1 Aug. 15, 2024

(30) Foreign Application Priority Data

Jun. 15, 2021 (CN) ..... 202110663606.3

(51) Int. Cl.
*A47L 11/30* (2006.01)
*A47L 11/40* (2006.01)

(52) U.S. Cl.
CPC ..... *A47L 11/30* (2013.01); *A47L 11/4016* (2013.01); *A47L 11/4083* (2013.01); *A47L 11/4088* (2013.01)

(58) Field of Classification Search
CPC ..... A47L 11/4088; A47L 11/4083; A47L 11/4016; A47L 11/30
(Continued)

(56) References Cited

U.S. PATENT DOCUMENTS 9,521,940 B2 * 12/2016 Johnson ..... A47L 13/225
9,661,966 B2 5/2017 Park et al.
(Continued)

FOREIGN PATENT DOCUMENTS

CN 1764409 A 4/2006
CN 101884514 A 11/2010
(Continued)

OTHER PUBLICATIONS

International Search Report for International Application No. PCT/CN2022/096916 of Aug. 17, 2022.
(Continued)

*Primary Examiner* — Katina N. Henson
(74) *Attorney, Agent, or Firm* — Perilla Knox & Hildebrandt; Kenneth A. Knox

(57) ABSTRACT

A cleaning device is disclosed that includes a main body, a cleaning assembly, and a connection mechanism. The cleaning device further includes a cleaning liquid supply system including a cleaning liquid reservoir and a cleaning liquid output pipeline; and a dirt recovery system including a dirt reservoir, a dirt suction pipeline and a fan assembly. The connection mechanism is configured to connect the main body and the cleaning assembly, and includes at least two rotational connection portions, rotation axes of which are not parallel to each other; and the at least two rotational connection portions are configured to enable the main body to rotate relative to the cleaning assembly about the rotation axis of each of the at least two rotational connection portions.

15 Claims, 6 Drawing Sheets

(58) Field of Classification Search
USPC ..... 15/320
See application file for complete search history.

(56) References Cited

U.S. PATENT DOCUMENTS

| | | | | |
|---|---|---|---|---|
| 2004/0134016 | A1* | 7/2004 | Kisela | A47L 9/2842 15/403 |
| 2004/0134025 | A1 | 7/2004 | Murphy et al. | |
| 2004/0163199 | A1 | 8/2004 | Hsu | |
| 2011/0219581 | A1 | 9/2011 | Mnes et al. | |
| 2012/0222227 | A1 | 9/2012 | Johnson et al. | |
| 2013/0067673 | A1* | 3/2013 | Yu | A47L 13/24 15/228 |

FOREIGN PATENT DOCUMENTS

| | | | |
|---|---|---|---|
| CN | 102711573 | A | 10/2012 |
| CN | 206354996 | U | 7/2017 |
| CN | 106998972 | A | 8/2017 |
| CN | 108903843 | A | 11/2018 |
| CN | 208677291 | U | 4/2019 |
| CN | 209269544 | U | 8/2019 |
| CN | 110338725 | A | 10/2019 |
| CN | 211243149 | U | 8/2020 |
| CN | 211484427 | U | 9/2020 |
| CN | 112312814 | A | 2/2021 |
| CN | 112716353 | A | 4/2021 |
| CN | 113616123 | A | 11/2021 |
| CN | 215605452 | U | 1/2022 |
| JP | 2006034604 | A | 2/2006 |
| JP | 2006516423 | A | 7/2006 |
| JP | 2018521724 | A | 8/2018 |
| JP | 2020199295 | A | 12/2020 |
| WO | 2008074014 | A2 | 6/2008 |
| WO | 2016022270 | A1 | 2/2016 |
| WO | 2020242180 | A1 | 12/2020 |

OTHER PUBLICATIONS

Extended European Search Report for EP Patent Application No. 22824073.5 of May 20, 2025.
Second Office Action for JP Patent Application No. 2023-577740 of Jun. 10, 2025.
First Office Action for CN Patent Application No. 202110663606.3 of Dec. 9, 2024.
First Office Action for AU Patent Application No. 2022291885 of Dec. 16, 2024.
First Office Action for JP Patent Application No. 2023-577740 of Jan. 14, 2025.
Chinese Patent Right Evaluation Report for CN Patent Application No. 202121339632.2 of Dec. 11, 2023.
Reconsideration Report by Examiner before Appeal for JP Patent Application No. 2023-577740 of Mar. 25, 2026.

* cited by examiner

CLEANING APPARATUS

CROSS-REFERENCE TO RELATED APPLICATIONS

This application is a national phase application under 35 U.S.C. § 371 of International Application No. PCT/CN2022/096916 filed on Jun. 2, 2022, which claims the benefit of and priority to Chinese Patent Application No. 202110663606.3 filed on Jun. 15, 2021, and the contents of which are hereby incorporated herein by reference in their entireties as part of this application.

TECHNICAL FIELD

Embodiments of the present disclosure relate to a cleaning device.

BACKGROUND

A cleaning device is typically employed to clean dirt on a surface, and generally includes a body, a cleaning head, and a motor. The cleaning device may spray a cleaning liquid onto the surface to be cleaned, and beat or rub the surface to be cleaned with the cleaning head, such that the dirt on the surface to be cleaned may be fully dissolved into waste water. Then, under wind power provided by the motor, the waste water is sucked into a recycling bin via a suction nozzle of the cleaning head. However, for the cleaning device, the adjustable angle as formed between the cleaning head and the main body is rather small, which causes the cleaning device to have poor flexibility and thus is not user-friendly.

BRIEF SUMMARY

A series of concepts in a simplified form are introduced in this section, and will be described in further detail in the Detailed Description section. This section of the present disclosure is not intended to limit the key features and necessary technical features of the technical solution as claimed, and let alone to attempt to determine the protection scope of the technical solution as claimed.

At least one embodiment of the present disclosure provides a cleaning device. The cleaning device includes a main body, a cleaning assembly and a connection mechanism, the main body being connected to the cleaning assembly by the connection mechanism. Furthermore, the cleaning device further includes:

- a cleaning liquid supply system provided on the main body and including a cleaning liquid reservoir and a cleaning liquid output pipeline, wherein the cleaning liquid reservoir is communicated with the cleaning liquid output pipeline; and
- a dirt recovery system provided on the main body and including a dirt reservoir, a dirt suction pipeline and a fan assembly, wherein the dirt reservoir is communicated with the dirt suction pipe and further in fluid communication with the fan assembly, wherein the connection mechanism includes at least two rotational connection portions; rotation axes of any two of the at least two rotational connection portions are not parallel to each other; and the at least two rotational connection portions are configured to rotate the main body relative to the cleaning assembly about the rotation axis of each of the at least two rotational connection portions.

BRIEF DESCRIPTION OF THE DRAWINGS

The following accompanying drawings of the present disclosure are taken herein as a part of embodiments of the present disclosure for the purpose of understanding the present disclosure. The accompanying drawings illustrate the embodiments of the present disclosure and descriptions thereof for explaining the principles of the present disclosure.

In the drawings.

Figure 1:
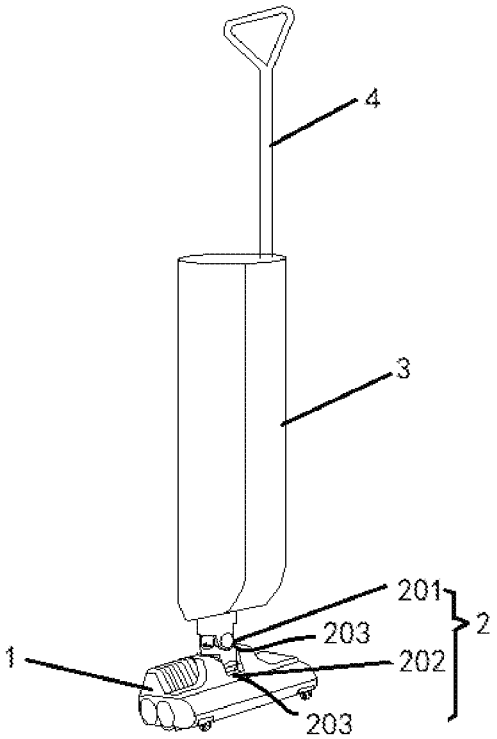
FIG. 1 is a structural diagram of a cleaning device according to an embodiment of the present disclosure.

Reference signs in the drawings: 1—cleaning assembly, 101—front roller brush, 102—rear roller brush, 2—connection mechanism, 201—first rotational connection portion, 2011—first connection member, 2012—second connection member, 2013—cover, 2014—first pivoting member, 20141—first pivoting shaft, 20142—fastener, 20143—first pivoting shaft, 2015—first connection lug, 2016—second connection lug, 202—second rotational connection portion, 2021—third connection member, 20211—first frame body, 20212—second frame body, 2022—second pivoting shaft, 2023—through hole, 20231—first recess, 20232—second recess, 203—rotational connection portion, 3—main body, 301—cleaning liquid reservoir, 302—fan assembly, 303—dirt reservoir, 4—handle, 5—dirt suction pipeline; 6—cleaning liquid output pipeline, 7—limiting portion, 8—shaft body, 9—first rotation axis, and 10—second rotation axis.

DETAILED DESCRIPTION

In the following description, a great deal of specific details is given to provide a more thorough understanding of the present disclosure. However, it is apparent to those skilled in the art that the present disclosure can be implemented without one or more of these details. In other examples, some technical features that are well known in the art will not be described to avoid confusion with the present disclosure.

It shall be noted that the terms used herein are merely intended to describe specific embodiments and are not intended to limit exemplary embodiments according to the present disclosure. As used herein, the singular form is also intended to include the plural form, unless the context clearly indicates otherwise. In addition, it shall also be understood that the terms "comprising" and/or "including", when used herein, may indicate the presence of stated features, wholes, steps, operations, components and/or assemblies, but do not exclude the presence or addition of one or more other features, wholes, steps, operations, components, assemblies and/or combinations thereof.

Exemplary embodiments of the present disclosure will be described herein in more detail with reference to the accompanying drawings. However, these exemplary embodiments may be implemented in a variety of different forms and shall not be construed as being limited to the embodiments set forth herein. It shall be understood that these embodiments are provided to make the content of the present disclosure thorough and complete and to fully communicate the ideas of these exemplary embodiments to those of ordinary skill in the art.

Figure 2:
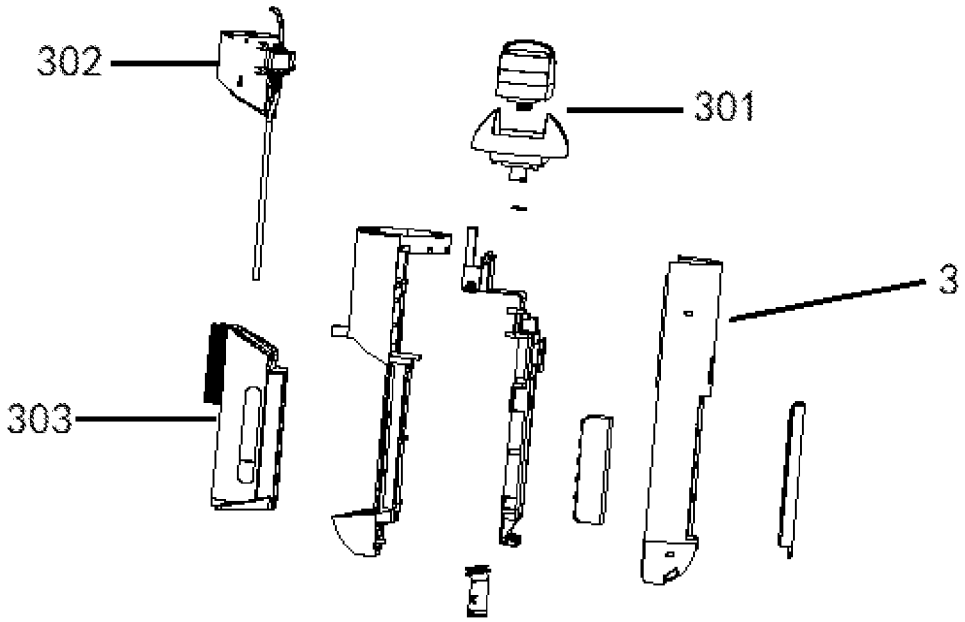
FIG. 2 is an exploded view of a main body according to an embodiment of the present disclosure.
Figure 4:
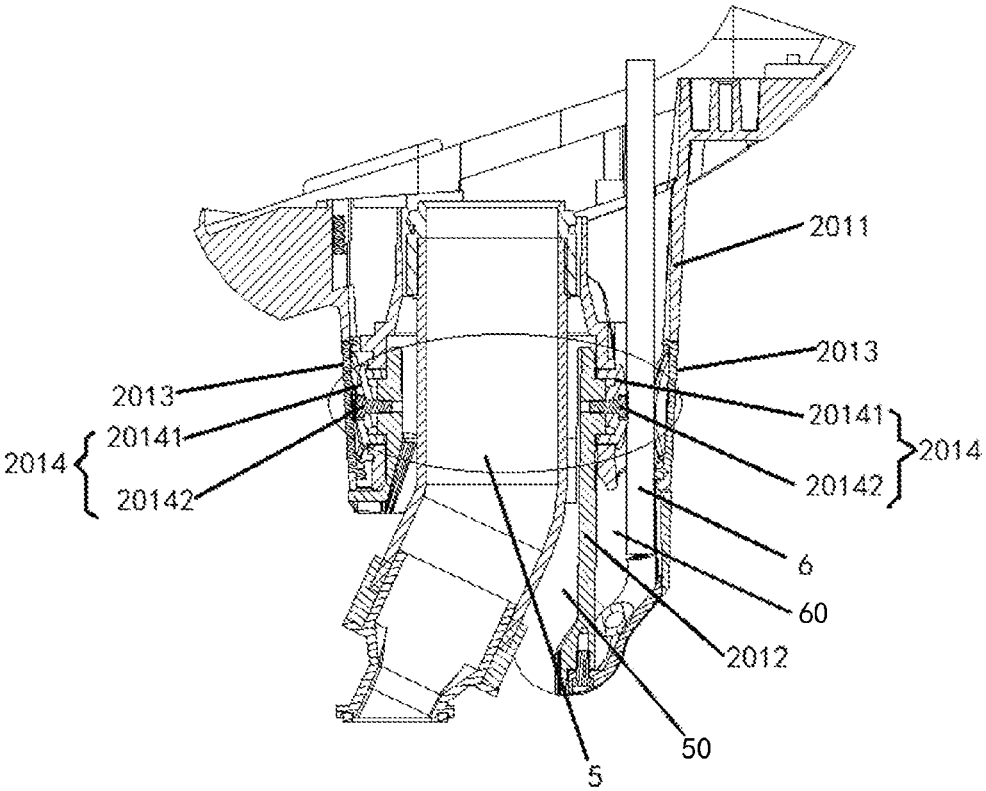
FIG. 4 is a schematic structural diagram of a first rotational connection portion according to an embodiment of the present disclosure.

As shown in FIGS. 1, 2 and 4, at least one embodiment of the present disclosure provides a cleaning device, which includes a main body 3, a cleaning assembly 1, and a connection mechanism 2. The cleaning device further includes a cleaning liquid supply system, and the cleaning liquid supply system includes a cleaning liquid reservoir 301 and a cleaning liquid output pipeline 6. The cleaning liquid reservoir 301 is communicated with the cleaning liquid output pipeline 6. The cleaning device further includes the dirt recovery system that includes a dirt reservoir 303, a dirt suction pipeline 5, and a fan assembly 302. The dirt reservoir 303 is communicated with the dirt suction pipeline 5, and is in fluid communication with the fan assembly 302. The connection mechanism 2 is configured to connect the main body 3 and the cleaning assembly 1, and includes at least two rotational connection portions. Rotation axes of any two of the at least two rotational connection portions are not parallel to each other; and the at least two rotational connection portions are configured to rotate the main body 3 relative to the cleaning assembly 1 about the rotation axis of each of the at least two rotational connection portions.

For example, the cleaning device may be a handheld mopping device or a handheld floor scrubbing device for cleaning areas such as floors, walls, tabletops, carpets, walls or glass, but is not limited thereto.

As shown in FIG. 1, a first end of the main body 3 is rotatably connected to the cleaning assembly 1 via the connection mechanism 2, and a second end of the main body 3 is provided with a handle 4. The handle 4 facilitates adjustment of an angle between the main body 3 and the surface to be cleaned by a user, and the user may control a moving direction and speed of the cleaning assembly 1 on the surface to be cleaned by applying a force to the handle 4. The main body 3 is further provided with a reception cavity therein for receiving various components and the like of the cleaning device.

Figure 3:
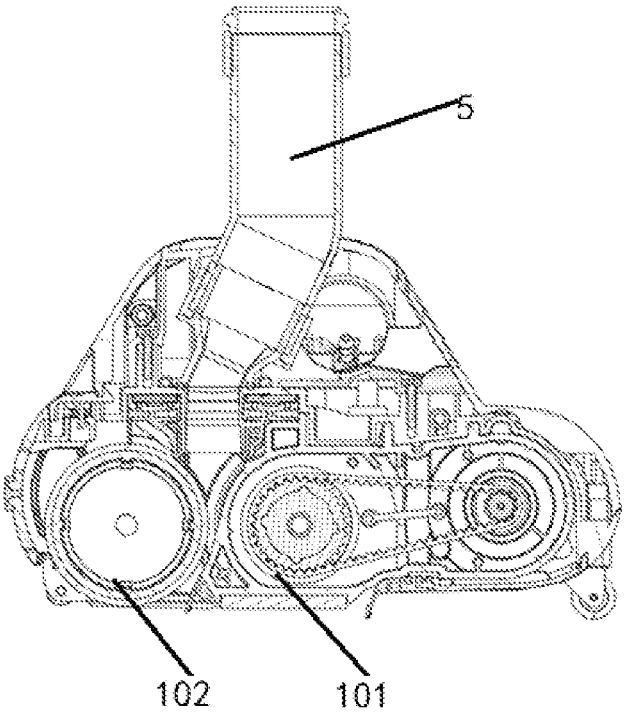
FIG. 3 is a sectional view of a cleaning assembly according to an embodiment of the present disclosure.

As shown in FIG. 3, the cleaning assembly 1 includes at least two roller brushes that are not coaxial with each other, and is configured to clean stains on a surface. In some embodiments of the present disclosure, the cleaning assembly 1 includes a front roller brush 101 and a rear roller brush 102. The front roller brush 101 and the rear roller brush 102 are provided in parallel and configured to rotate in different circumferential directions, such that trash or stains on the surface to be cleaned may be received between the front roller brush 101 and the rear roller brush 102. In an embodiment of the present disclosure, the cleaning assembly is provided with a posture sensor, which may be for example provided on the roller brush for sensing information about the moving direction of the cleaning assembly 1. When the cleaning assembly 1 is detected to move forward, the front roller brush 101 is controlled to have a higher rotation speed than the rear roller brush 102. When the cleaning assembly 1 is detected to move backward, the front roller brush 101 is controlled to have a lower rotation speed than the rear roller brush 102 to provide assistance during the cleaning process, thereby improving the user experience. In another embodiment of the present disclosure, the posture sensor is provided at the other position of the cleaning device, which is not limited by the present disclosure.

As shown in FIGS. 2 and 4, the cleaning device in an embodiment of the present disclosure includes a cleaning liquid supply system. The cleaning liquid supply system includes a cleaning liquid reservoir 301 and a cleaning liquid output pipeline 6, and the cleaning liquid reservoir 301 is in fluid communication with the cleaning liquid output pipeline 6. The cleaning liquid supply system further includes a nozzle, and the nozzle is provided on the cleaning liquid output pipeline 6 and configured to dispense a cleaning liquid to the cleaning assembly 1. The main body 3 is provided with a mounting groove for receiving the cleaning liquid reservoir 301. The cleaning liquid supply system further includes a pump, and the pump is provided on the cleaning liquid output pipeline 6 to deliver a sufficient amount of cleaning liquid to the nozzle in a timely manner, thereby wetting the surface to be cleaned. Then, the wetted surface to be cleaned is scrubbed by the front roller brush 101 and rear roller brush 102 of the cleaning assembly, thereby achieving a scrubbing effect on the surface to be cleaned.

As shown in FIG. 3, the cleaning device includes a dirt recovery system. The dirt recovery system includes a dirt reservoir 303 and at least one dirt suction pipeline 5, and is configured to recover stains and debris received between the front roller brush 101 and the rear roller brush 102 or remained on the surface to be cleaned. In an embodiment of the present disclosure, the dirt suction pipeline 5 has an inlet and an outlet. The inlet of the dirt suction pipeline 5 is provided above a position, where the front roller brush 101 and the rear roller brush 102 are adjacent to each other, and configured to face the surface to be cleaned; and the outlet of the dirt suction pipeline 5 is connected to the dirt reservoir 303. The dirt reservoir 303 is also in fluid communication with the fan assembly 302 capable of providing negative pressure. The stains, under the action of the negative pressure, may be sucked from the inlet of the dirt suction pipeline 5 to the dirt reservoir 303, thereby recovering the stains.

It shall be understood that the cleaning liquid may be any of clean water, a cleaning agent, or a mixture of the clean water and the cleaning agent. The dirt may include debris, dirt liquid, and the like on the surface to be cleaned. The cleaning liquid reservoir and the dirt reservoir represent containers with a reception cavity, the shape and size of which are not limited in the present disclosure.

In some embodiments of the present disclosure, the cleaning device further includes a detection device, a processor, and a battery assembly.

The detection device is configured to detect a physical property value of the cleaning assembly. In an embodiment of the present disclosure, the detection device is provided on the cleaning assembly 1. In another embodiment of the present disclosure, the detection device is provided opposite to the cleaning assembly 1. The detection device may be an optical detection device or an electrical detection device, which is not strictly limited in the present disclosure.

The processor is electrically connected to the detection device, and is configured to acquire the physical property value as detected by the detection device and determine the dirt degree of the surface to be cleaned based on the physical property value. The dirt degree of the surface to be cleaned may be determined by the processor intelligently based on the physical property value without manual judgment. Thus, information about the surface to be cleaned may be provided for the cleaning work of the cleaning device, thereby improving the intelligence of the cleaning device and meanwhile enhancing the user experience. The processor may be implemented by various application specific integrated circuits (ASICs), digital signal processors (DSPs), digital signal processing devices (DSPDs), programmable logic devices (PLDs), field programmable gate arrays (FPGAs), microprocessors, and other electronic elements.

The battery assembly includes a rechargeable battery, a charging circuit, and a charging electrode. The charging circuit is electrically connected to the charging battery, and the charging electrode is provided at the bottom of the main body 3. In some embodiments of the present disclosure, the charging circuit includes a charging control circuit, a charging-temperature detection circuit, and a charging-voltage detection circuit. In some embodiments of the present disclosure, the charging electrodes are strip-shaped and include two electrodes.

In an embodiment of the present disclosure, the min body 3 is connected to the cleaning assembly 1 via the connection mechanism 2 as shown in FIG. 1. The connection mechanism 2 includes at least two rotational connection portions 203, and the main body 3 may rotate relative to the cleaning assembly 1 about the rotation axis of each rotational connection portion 203. An angle is formed between the rotation axes of any two rotational connection portions 203. That is, the rotation axes of any two rotational connection portions are not parallel, which ensures that rotation directions of the main body 3 around various rotation axes are different. As a result, the user can adjust the angle between the main body 3 and the cleaning assembly 1 in a plurality of directions with only a small operation in situ, which not only increases the flexibility of the cleaning assembly 1, but also facilitates the user's control of the cleaning assembly 1 and thus facilitates the user's operation. Furthermore, the cleaning device is in a non-working state and is powered off when the main body 3 is perpendicular to the cleaning assembly 1 and is namely in an upright position. When the main body 3 is in a tilted state relative to the cleaning assembly 1 or even in a near-vertical state, the cleaning device is powered on and switched to the working state. Thus, the cleaning device can be automatically activated and deactivated via the tilt angle of the main body 3 relative to the cleaning assembly 1, thereby further facilitating the user's operation and improving intelligence of the cleaning device.

Figure 11:
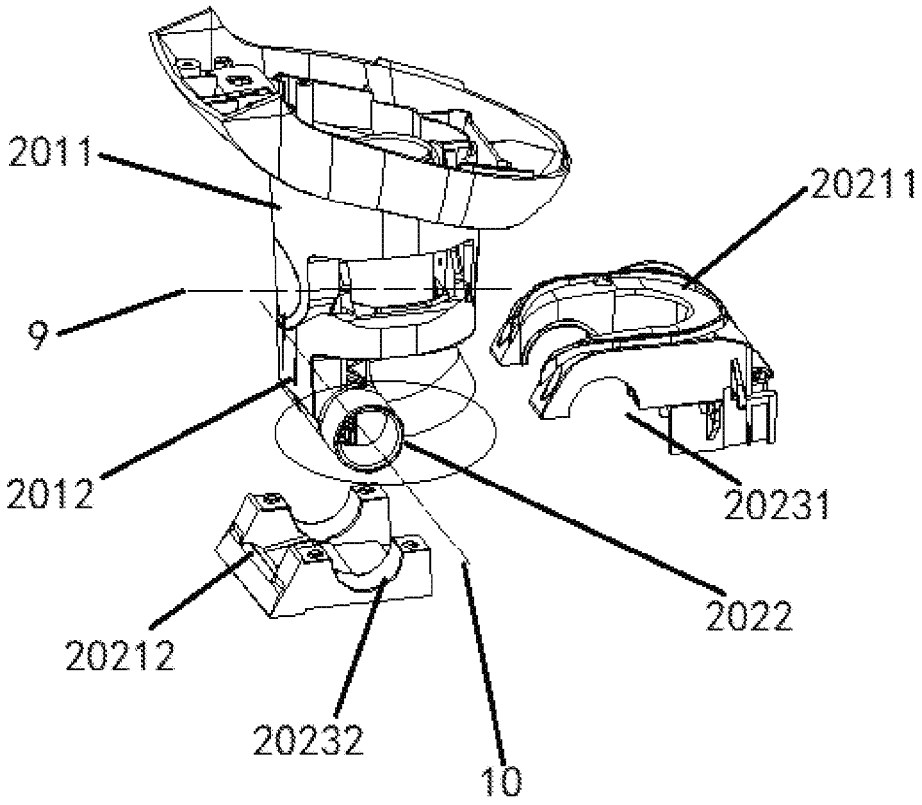
FIG. 11 is an exploded view of FIG. 10.

In an embodiment of the present disclosure, as shown in FIGS. 1 and 11, the at least two rotational connection portions 203 include a first rotational connection portion 201 and a second rotational connection portion 202. The first rotational connection portion 201 is configured to rotate the main body 3 relative to the cleaning assembly 1 about the first rotation axis 9 of the first rotational connection portion 201. The second rotational connection portion 202 is configured to rotate the main body 3 relative to the cleaning assembly 1 about a second rotation axis 10 of the second rotational connection portion 202, the first rotation axis 9 being perpendicular to the second rotation axis 10.

The connection mechanism includes the two rotational connection portions, and the rotation axes of the two rotational connection portions are perpendicular to each other, such that the angle between the main body 3 and the cleaning assembly 1 can be adjusted in a plurality of directions. Furthermore, the number of rotational connection portions is reduced to the minimum as much as possible to simplify the structure of the rotation mechanism, thereby facilitating the production.

Figure 8:
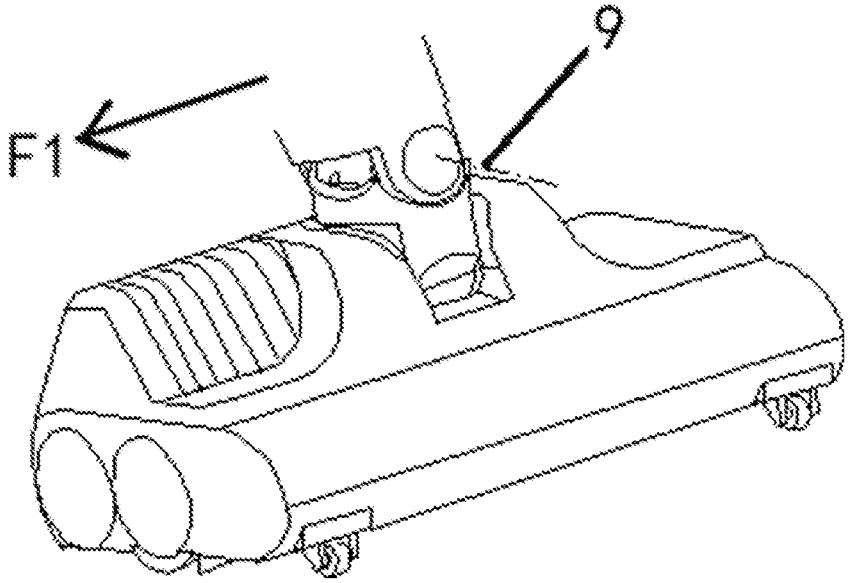
FIG. 8 is a diagram showing a use state of the first rotational connection portion according to an embodiment of the present disclosure.
Figure 9:
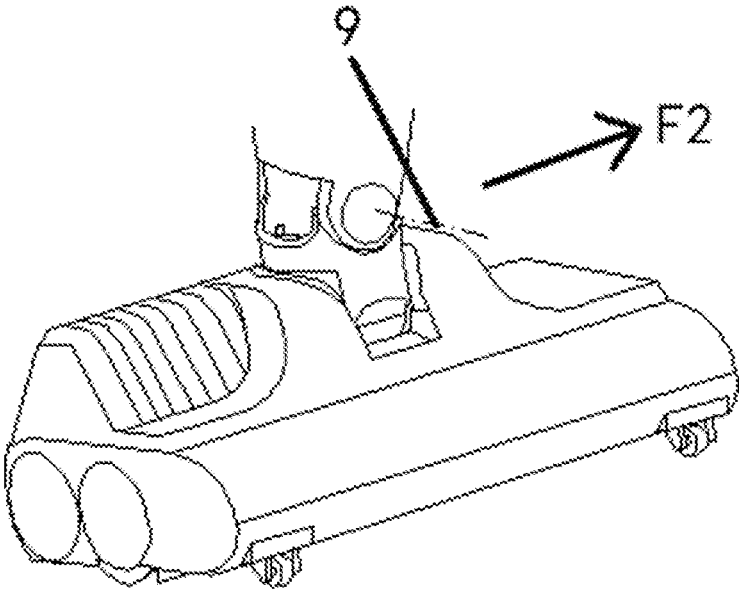
FIG. 9 is a diagram showing a use state of the first rotational connection portion according to another embodiment of the present disclosure.

In some embodiments of the present disclosure, as shown in FIGS. 8 and 9, the first rotation axis 9) extends in a first direction which is a moving direction of the cleaning device at work.

In the aforesaid embodiment, the second rotation axis 10 is perpendicular to the first rotation axis 9, which means that the second rotation axis 10 is perpendicular to the moving direction of the cleaning device at work. Thus, when the cleaning device is used, the main body 3 rotates about the second rotation axis 10 to change the angle of the main body 3 and the first direction, and cause the main body 3 to be tilted relative to the first direction. As a result, the user is allowed to push the handle 4 to move the cleaning assembly 1 in the first direction, such that the surface to be cleaned can be cleaned in the first direction. Furthermore, by changing the angle of the main body 3 and the first direction, the needs of users of different heights can be met. In addition, the cleaning assembly 1 may fit more closely the surface to be cleaned under the downward pressure as generated by the gravity of the main body 3, which also allows the user to push the cleaning device via the handle 4 with less effort.

When a region below a lower object (such as the bottom of a bed or table) is cleaned, the main body 3 may be actuated to rotate at a greater angle about the second rotation axis 10 to reduce the angle between the main body 3 and the first direction, such that the user can move the cleaning assembly 1 to clean the region below the lower object without bending down, thereby improving the comfort level for the user.

When the cleaning direction of the cleaning device needs to be adjusted, the main body 3 may rotate about the first rotation axis 9 to change the angle between the main body 3 and the second direction perpendicular to the first direction. As a result, the user may push the handle 4 to move the cleaning assembly 1 in the second direction, such that the cleaning direction of the cleaning device can be changed in situ without lifting the entire cleaning device. Exemplarily, as shown in FIG. 8, in a case where the cleaning device needs to move to the right side, a leftward acting force F1 shall be applied to the handle 4 to rotate the main body 3 to the left side about the first rotation axis 9. Then, the main body 3 is tilted to the left side to cause the cleaning assembly 1 to move to the right side, thereby changing the moving direction of the cleaning device. Thus, the user may change the moving direction of the cleaning device and make the cleaning device move towards the right by applying the leftward acting force to the handle 4. Similarly, as shown in FIG. 9, in a case where the cleaning device needs to move to the left side, a rightward acting force F2 shall be applied to the handle 4, such that the main body 3 rotates to the right side about the first rotation axis 9, and hence tilted to the right side. Thus, the user may cause the cleaning assembly 1 to move left merely by applying the rightward force to the handle 4, thereby changing the moving direction of the cleaning device. The leftward acting force F1 and the rightward acting force F2 are in opposite directions, and both directions are perpendicular to the first rotation axis 9. As a result, the cleaning direction can be changed under a smaller range of operation of the operator, which increases the comfort level and convenience of operation, and is especially suitable for cleaning in relatively narrow spaces.

In an embodiment of the present disclosure, as shown in FIG. 1, the first rotational connection portion 201 and the second rotational connection portion 202 are sequentially provided along the length direction of the main body 3 to make the most of the space of the cleaning device, thereby making the structure more compact, and reducing the overall volume of the cleaning device.

In an embodiment of the present disclosure, as shown in FIGS. 1 and 11, the first rotational connection portion 201 is disposed at a side of the second rotational connection portion 202 proximate to the handle to rotate the main body 3 about the first rotation axis 9. Furthermore, during the process of changing the angle of the main body 3 and the second direction, the interference between the main body 3 and the cleaning assembly 1 can be prevented, thereby increasing the adjustment range of the angle.

Figure 6:
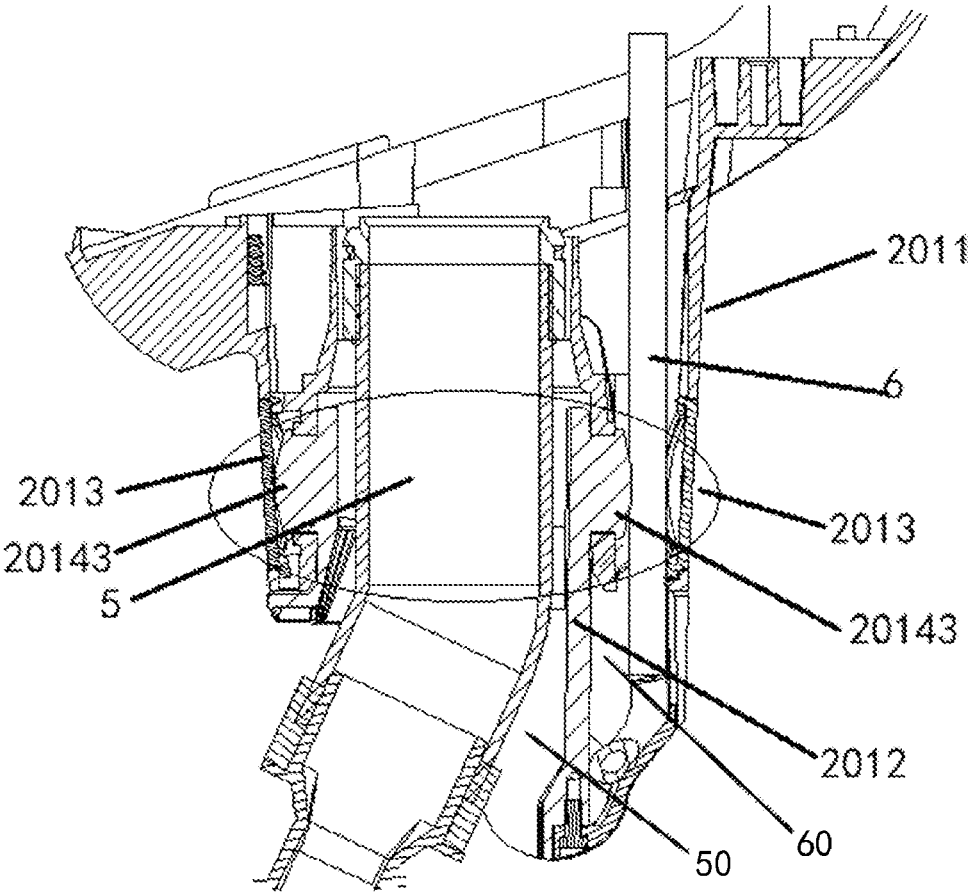
FIG. 6 is a schematic structural diagram of a first rotational connection portion according to another embodiment of the present disclosure.

In an embodiment of the present disclosure, as shown in FIGS. 4 and 6, the first rotational connection portion 201 includes a first connection member 2011, a second connection member 2012 and a first pivoting member 2014. The first connection member 2011 is connected to the main body 3, and the second connection member 2012 is rotatably connected to the first connection member 2011 via the first pivoting member 2014.

The first connection member 2011 may be of a structure in any shape, which is not strictly limited in this embodiment. In some possible embodiments, the first connection member 2011 is of a narrow hollow cylindrical structure, and the second connection member 2012 has a similar structure to the first connection member 2011. That is, in the case where the first connection member 2011 is of a narrow hollow cylindrical structure, the second connection member 2012 also has a similar hollow cylindrical structure to facilitate the connection with the first connection member 2011.

In an embodiment of the present disclosure, as shown in FIGS. 4 and 6, the first rotational connection portion 201 includes two first pivoting members 2014. The two first pivoting members 2014 are disposed on two sides of the first connection member 2011 respectively, and provided coaxially along the first rotation axis. The two first pivoting members 2014 are provided coaxially along the first rotation axis, which means that the central axes of the two first pivoting members 2014 are provided on the first rotation axis to enable the main body 3 to rotate about the first rotation axis 9.

The rotational connection between the first connection member 2011 and the second connection member 2012 may be implemented by the first pivoting member 2014 of different structures, and the different structures of the first pivoting member 2014 will be described in detail below.

Figure 10:
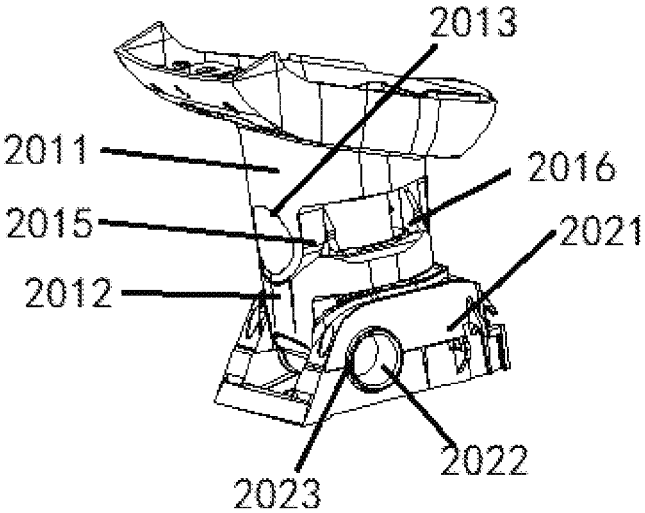
FIG. 10 is a schematic structural diagram of a connection mechanism according to an embodiment of the present disclosure.

First structure: as shown in FIGS. 4 and 10, each first pivoting member 2014 includes a first pivoting shaft 20141 and a fastener 20142. The first connection member 2011 is rotatably connected to the first pivoting shaft 20141, and the first pivoting shaft 20141 is fixedly connected to the second connection member 2012 via the fastener 20142.

Figure 5:
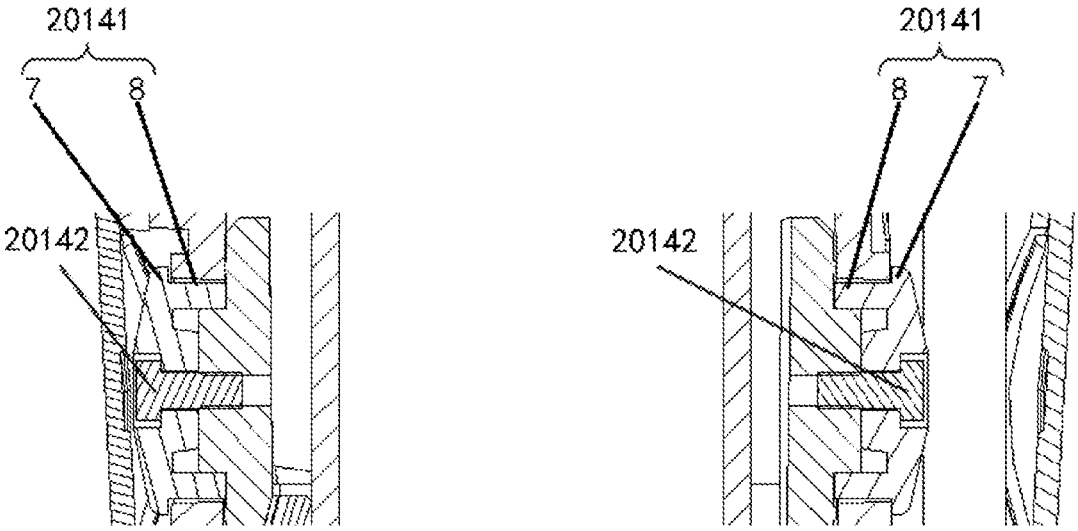
FIG. 5 is an enlarged partial view of FIG. 4.

For example, the first connection member 2011 is provided with a first connection lug 2015 on each of two opposite sides thereof, and each first connection lugs 2015 is provided with a shaft hole adapted to the first pivoting shaft 20141. Further, the second connection member 2012 is provided with a second connection lug 2016 on each of two opposite sides thereof. As shown in FIGS. 5 and 10, the first pivoting shaft 20141 includes a shaft body 8 and a limiting portion 7 provided at an end of the shaft body 8 distal from the second connection member 2012. The end of the shaft body 8 distal from the limiting portion 7 passes through the shaft hole on the first connection lug 2015 and is fixedly connected to the second connection lug 2016 of the second connection member 2012 via the fastener 20142. Meanwhile, the limiting portion 7 abuts against the edge of the shaft hole to prevent the shaft body 8 from being dislodged from the shaft hole, such that the shaft hole can rotate relative to the shaft body 8, thereby allowing the first connection member 2011 to rotate relative to the second connection member 2012 about the centerline of the first pivoting member 2014. That is, the main body 3 can rotate relative to the cleaning assembly 1 around the first rotation axis 9. The fastener 20142 may be screws or other existing components that have the function for fixing, which is not strictly limited in this embodiment.

The first pivoting member 2014 of this structure may be of a split structure, which not only reduces the complexity in manufacturing the first pivoting member 2014, but also facilitates the replacement of the first pivoting member 2014 in case the first pivoting member 2014 wears out.

Second structure: as shown in FIG. 6, each first pivoting member 2014 includes a first pivoting shaft 20143. The first pivoting shaft 20143 is integrally formed with the second connection member 2012, and the first pivoting shaft 20143 passes through the first connection member 2011 to form a rotational connection with the first connection member 2011.

Figure 7:
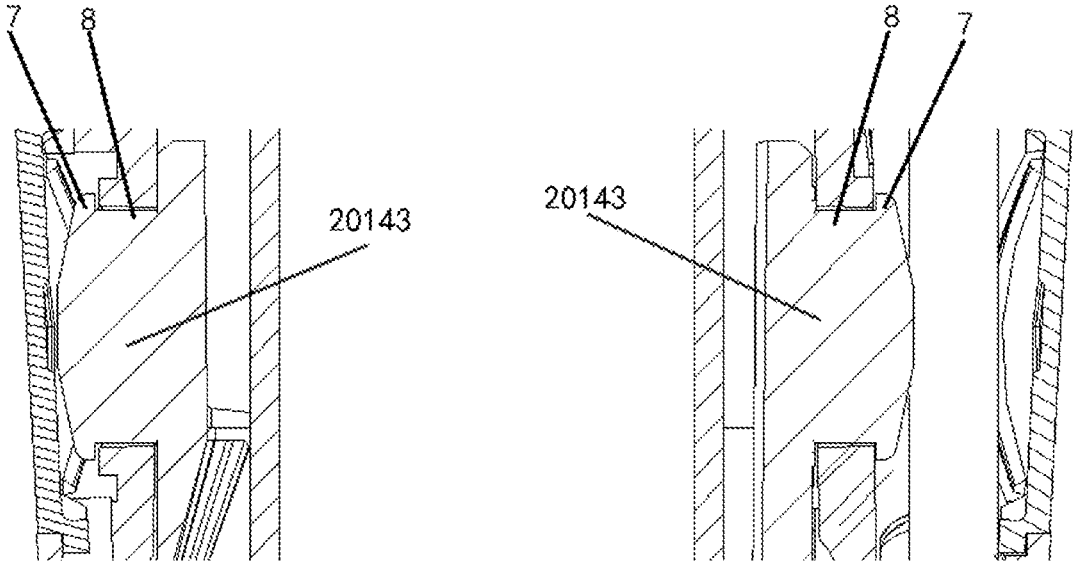
FIG. 7 is an enlarged partial view of FIG. 6.

The first connection member 2011 and the second connection member 2012 may be of a structure according to the aforesaid embodiments, which will not be repeated herein. As shown in FIGS. 7 and 10, the first pivoting shaft 20143 includes a shaft body 8 and a limiting portion 7 at an end of the shaft body 8. The end of the shaft body 8 distal from the limiting portion 7 is connected to a second connection lug 2016 of the second connection member 2012, and a shaft hole of the first connection lug 2015 sleeves the shaft body 8. The limiting portion 7 abuts against the edge of the shaft hole to prevent the shaft body 8 from being dislodged from the shaft hole, such that the shaft hole can rotate relative to the shaft body 8, thereby allowing the first connection member 2011 to rotate relative to the second connection member 2012 about the centerline of the first pivoting member 2014. That is, the main body 3 can relative to the cleaning assembly 1 around the first rotation axis 9.

The first pivoting member 2014 of this structure is integrally formed with the second connection member 2012 directly, which requires no fastener to connect the first pivoting member 2014 fixedly to the second connection member 2012, thereby reducing the number of components of the first pivoting member 2014, and simplifying the structure of the first pivoting member 201. Furthermore, there is no need to assemble and connect the first pivoting member 2014 to the second connection member 2012, which also simplifies the assembly process.

The rotational connection between the first connection member and the second connection member may be implemented by configuring the first pivoting shaft 20143 of the first pivoting member 2014 to be rotatably connected to the first connection member 2011 and meanwhile configuring the first pivoting shaft 20143 to be fixedly connected to the second connection member 2012.

Further, as shown in FIGS. 4 and 6, the first connection member 2011 is depressed inwardly at a position corresponding to the first pivoting member 2014, and the depression is covered with a detachable cover 2013.

The first connection member 2011 is depressed inwardly at a position corresponding to the first pivoting member 2014 to form a reception cavity for receiving the first pivoting member 2014, which makes the structure more compact and reduces the space as occupied. The cover 2013 may protect the first pivoting member 2014 to prevent the first pivoting member 2014 from being damaged by the collision of objects and the like, thereby prolonging the service life of the first pivoting member 2014. The detachable cover 2013 may be easily removed and snapped on, such that the first pivoting member 2014 can be protected without hindering the replacement of the first pivoting member 2014. The detachable connection may be implemented by existing connection fashions such as snap or bolt connections, which are not limited by this embodiment.

Furthermore, as shown in FIG. 10, an outer surface of the cover 2013 is flush with an outer surface of the first connection member 2011 and an outer surface of the second connection member 2012. As a result, the connection mechanism 2 as a whole has no protruding portion, which reduces the probability of items colliding with the connection mechanism 2 during the movement, and reduces the size and occupied space of the connection mechanism 2.

As shown in FIG. 10, the second rotational connection portion 202 includes a second pivoting member and a third connection member 2021. The third connection member 2021 is mounted on the cleaning assembly 1, the second connection member 2012 is rotatably connected to the third connection member 2021 via the second pivoting member, and the rotation axis of the second pivoting member extends in the same direction as the second direction, the second direction being perpendicular to the first direction.

The central axis of the second pivoting member is the second rotation axis 10. In this way, the second connection member 2012 rotates relative to the third connection member 2021 about the central axis of the second pivoting member, which also enables the main body 3 to rotate relative to the cleaning assembly 1 about the second rotation axis 10.

In an embodiment of the present disclosure, as shown in FIGS. 8 and 9, the upper surface of the cleaning assembly 1 may be provided with a reception groove. The reception groove is provided with an opening in the first direction, and the opening may prevent the second connection member 2012 from being obstructed while rotating relative to the third connection member 2021 about the central axis of the second pivoting member. The third connection member 2021 is provided in the reception groove to improve the compactness of the structure and reduce the overall size and occupied space of the cleaning device.

In an embodiment of the present disclosure, as shown in FIG. 11, the third connection member 2021 includes a first frame body 20211 and a second frame body 20212. The first frame body 20211 is detachably connected to the second frame body 20212. The first frame body 20211 is provided with a first recess 20231 on each of two sides, and the second frame body 20212 is provided with a second recess 20232 on each of two sides. When the first frame body 20211 is connected to the second frame body 20212, the first recess 20231 and the second recess 20232 are combined to form a through hole 2023 adapted to the second pivoting member, such that the second pivoting member is provided in the through hole 2023 and forms a rotational connection with the third connection member 2021.

The detachable connection between the first frame body 20211 and the second frame body 20212 may be implemented by existing connection fashions, such as snap or bolt connections, which are not limited by embodiments of the present disclosure. The detachable connection between the first frame body 20211 and the second frame body 20212 facilitates the assembly of the third connection member 2021 and the second pivoting member and also the replacement of the second pivoting member when the second pivoting member wears out.

In an embodiment of the present disclosure, as shown in FIG. 11, the second pivoting member includes a second pivoting shaft 2022, and the second pivoting shaft 2022 is integrally formed with the second connection member 2012.

Figure 12:
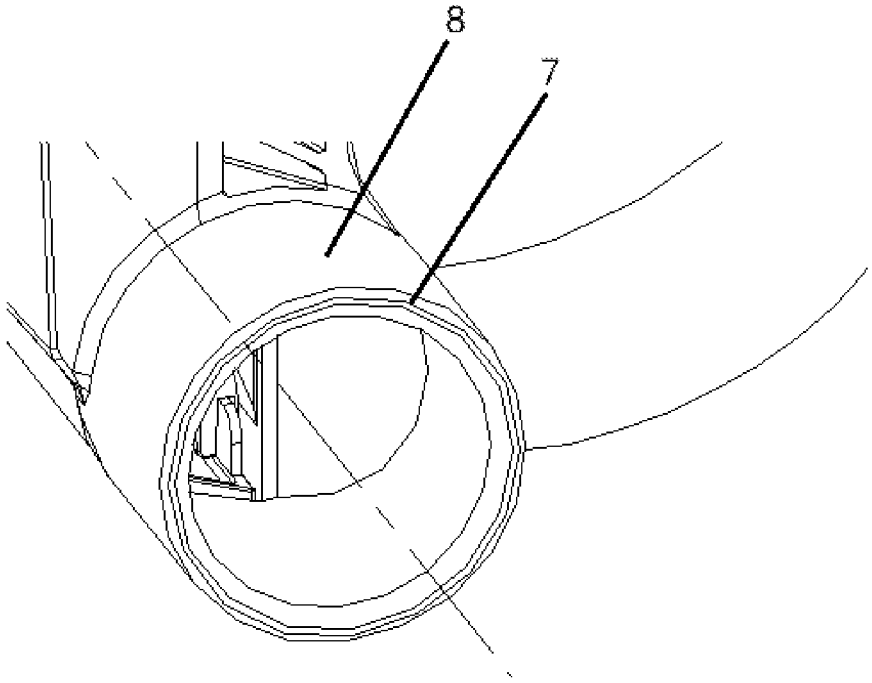
FIG. 12 is an enlarged partial view of FIG. 11.

As shown in FIGS. 11 and 12, the second pivoting shaft 2022 includes a shaft body 8 and limiting portions 7 at both ends of the shaft body 8. The central portion of the shaft body 8 is provided in the through hole 2023 formed by the first recess 20231 and the second recess 20232 of the third connection member 2021, and the limiting portion 7 abuts against the edge of the through hole 2023 to prevent the shaft body 8 from being dislodged from the through hole 2023. As a result, the second connection member 2012 may drive the shaft body 8 to rotate in the through hole 2023, and the second connection member 2012 may thus rotate relative to the third connection member 2021 about the centerline of the second pivoting member. That is, the main body 3 may rotate relative to the cleaning assembly 1 about the second rotation axis 10.

The second pivoting shaft 2022 is integrally formed with the second connection member 2012, which requires no fastener 20142 to implement the fixed connection, thereby reducing the number of components and simplifying the structure of the second pivoting member. Furthermore, there is no need to assemble and connect the second pivoting member to the second connection member 2012, which also simplifies the assembly process.

In an embodiment of the present disclosure, as shown in FIGS. 4 and 6, the first connection member 2011 and the second connection member 2012 are further provided with a first passage 60 for arrangement of a circuit and a cleaning liquid output pipeline 6, and a second passage 50 for arrangement of a dirt suction pipeline 5.

The cleaning liquid output pipeline 6 and the dirt suction pipeline 5 may be pipelines of soft materials such as a plastic hose. Accordingly, the cleaning liquid output pipeline 6 and the dirt suction pipeline 5 may be bent with the rotation while the main body 3 rotates relative to the cleaning assembly 1, which can ensure a smooth rotation and prevent affecting normal use of the pipeline.

In embodiments of the present disclosure, by providing the first passage 60 and the second passage 50, different pipelines can be arranged conveniently, and the interaction and interference between the cleaning liquid output pipeline 6 and the dirt suction pipeline 5 can be reduced.

In an embodiment of the present disclosure, as shown in FIGS. 4 and 6, both the first connection member 2011 and the second connection member 2012 are of a hollow structure. The first passage 60 is disposed between the first connection member 2011 and the second connection member 2012, and is namely a space on the outside of the first pivoting member 2014 for receiving the cleaning liquid output pipeline 6. The second passage 50 passes through the first connection member 2011 and the second connection member 2022, and is namely a space between the two first pivoting members 2014 for receiving the dirt suction pipeline 5. In addition, the two passages are provided separately, such that they may not contact and thus interfere with each other even if the cleaning liquid output pipeline 6 and the dirt suction pipeline 5 are bent in the process in which the main body 3 rotates relative to the cleaning assembly 1.

According to some embodiments of the present disclosure, the rotational connection portions include a first rotational connection portion configured to rotate the main body relative to the cleaning assembly about a first rotation axis of the first rotational connection portion, and a second rotational connection portion configured to rotate the main body relative to the cleaning assembly about a second rotation axis of the second rotational connection portion, the first rotation axis being perpendicular to the second rotation axis.

According to some embodiments of the present disclosure, the first rotation axis extends along a first direction, which is a moving direction of the cleaning device at work.

According to some embodiments of the present disclosure, the first rotational connection portion and the second rotational connection portion are provided sequentially along a length direction of the main body.

According to some embodiments of the present disclosure, the first rotational connection portion is configured to connect to the main body, and the second rotational connection portion is configured to connect to the cleaning assembly.

According to some embodiments of the present disclosure, the first rotational connection portion includes a first connection member, a second connection member and at least one first pivoting member. The first connection member is connected to the main body, and the second connection member is rotatably connected to the first connection member via the at least one first pivoting member.

According to some embodiments of the present disclosure, the at least one first pivoting member includes two first pivoting members, and the two first pivoting members are disposed on two sides of the first connection member respectively and coaxially provided in a direction perpendicular to the first direction.

According to some embodiments of the present disclosure, each of the two first pivoting members includes a first pivoting shaft which is rotatably connected to the first connection member and is fixedly connected to the second connection member.

According to some embodiments of the present disclosure, the first pivoting shaft is fixedly connected to the second connection member via a fastener.

According to some embodiments of the present disclosure, the first pivoting shaft is integrally formed with the second connection member, and passes through the first connection member to be rotatably connected with the first connection member.

According to some embodiments of the present disclosure, the first rotational connection portion further includes: a first passage for arrangement of an electric circuit and the cleaning liquid output pipeline, and a second passage for arrangement of the dirt suction pipeline.

According to some embodiments of the present disclosure, the first connection member and the second connection member are both of a hollow structure, and the first passage is disposed between the first connection member and the second connection member, and the second passage passes through the first connection member and the second connection member.

According to some embodiments of the present disclosure, the first connection member is provided with a depression in a position corresponding to the first pivoting member, and the connection mechanism further comprises a cover for detachably covering the depression.

According to some embodiments of the present disclosure, an outer surface of the cover is flush with an outer surface of the first connection member.

According to some embodiments of the present disclosure, the second rotational connection portion includes a second pivoting member and a third connection member that is mounted on the cleaning assembly. The second connection member is rotatably connected to the third connection member via the second pivoting member; and a rotation axis of the second pivoting member extends in a direction perpendicular to the first direction.

According to some embodiments of the present disclosure, the third connection member includes a first frame body and a second frame body. The first frame body is detachably connected to the second frame body, the first frame body is provided with a first recess on each of both sides, and the second frame body is provided with a second recess on each of both sides. When the first frame body is connected to the second frame body, the first recess and the second recess are combined to form a through hole for receiving a second pivoting shaft of the second pivoting member, thereby allowing the second pivoting member to be rotatably connected to the third connection member.

According to some embodiments of the present disclosure, the second pivoting shaft is integrally formed with the second connection member.

For the cleaning device according to the embodiments of the present disclosure, the main body of the cleaning device may rotate relative to the cleaning assembly about the rotation axes of different rotational connection portions. Thus, the user can adjust the angle between the main body and the cleaning assembly in a plurality of directions with only a small operation in situ, which can not only increase the flexibility of the cleaning assembly, but also facilitate the user's control of the cleaning assembly and facilitate the user's operation.

The present disclosure has been illustrated by aforesaid embodiments, but it shall be understood that the aforesaid embodiments are merely exemplary and illustrative, and are not intended to limit the present disclosure to the scope of the embodiments as described. Further, it may be understood by those skilled in the art that the present disclosure is not limited to the aforesaid embodiments and that a greater variety of variations and modifications may be made in accordance with the teachings of the present disclosure, all of which fall within the protection scope as claimed by the present disclosure. The protection scope of the present disclosure is defined by the appended claims and their equivalents.

What is claimed is:

1. A cleaning device, comprising:

a main body, a cleaning assembly, and a connection mechanism;

a cleaning liquid supply system comprising a cleaning liquid reservoir and a cleaning liquid output pipeline, wherein the cleaning liquid reservoir is connected to the cleaning liquid output pipeline; and a dirt recovery system comprising a dirt reservoir, a dirt suction pipeline, and a fan assembly, wherein the dirt reservoir is communicated with the dirt suction pipeline and further in fluid communication with the fan assembly, wherein;

the connection mechanism is configured to connect the main body and the cleaning assembly, and comprises at least two rotational connection portions, rotation axes of which not being parallel to each other;

the at least two rotational connection portions are configured to enable the main body to rotate relative to the cleaning assembly about the rotation axis of each of the at least two rotational connection portions;

the at least two rotational connection portions comprise a first rotational connection portion and a second rotational connection portion, and the first rotational connection portion is configured to enable the main body to rotate relative to the cleaning assembly about a first rotation axis of the first rotational connection portion;

the first rotational connection portion comprises a first connection member, a second connection member and at least one first pivoting member;

the first connection member and the second connection member in the first rotational connection portion are further provided with a first passage for arrangement of a circuit and the cleaning liquid output pipeline, and a second passage for arrangement of the dirt suction pipeline; and the second connection member is rotatably connected to the first connection member via the at least one first pivoting member, the first passage is on the outside of the first pivoting member, and the second passage is between two first pivoting members.

2. The cleaning device according to claim 1, wherein the second rotational connection portion is configured to enable the main body to rotate relative to the cleaning assembly about a second rotation axis of the second rotational connection portion, the first rotation axis being perpendicular to the second rotation axis.

3. The cleaning device according to claim 2, wherein the first rotation axis extends along a first direction, the first direction being a moving direction of the cleaning device at work.

4. The cleaning device according to claim 3, wherein the second rotational connection portion comprises a second pivoting member and a third connection member that is mounted on the cleaning assembly; the second connection member is rotatably connected to the third connection member via the second pivoting member; and a rotation axis of the second pivoting member extends in a direction perpendicular to the first direction.

5. The cleaning device according to claim 4, wherein the third connection member comprises a first frame body and a second frame body, wherein the first frame body is detachably connected to the second frame body, the first frame body is provided with a first recess on each of both sides, and the second frame body is provided with a second recess on each of both sides; and when the first frame body is connected to the second frame body, the first recess and the second recess are combined to form a through hole for receiving a second pivoting shaft of the second pivoting member, thereby allowing the second pivoting member to be rotatably connected to the third connection member.

6. The cleaning device according to claim 5, wherein the second pivoting shaft is integrally formed with the second connection member.

7. The cleaning device according to claim 2, wherein the first rotational connection portion and the second rotational connection portion are provided sequentially along a length direction of the main body.

8. The cleaning device according to claim 2, wherein the first connection member is connected to the main body.

9. The cleaning device according to claim 8, wherein the at least one first pivoting member comprises two first pivoting members, and the two first pivoting members are disposed on two sides of the first connection member respectively and coaxially provided in a direction perpendicular to the first direction.

10. The cleaning device according to claim 9, wherein each of the two first pivoting members comprises a first pivoting shaft which is rotatably connected to the first connection member and is fixedly connected to the second connection member.

11. The cleaning device according to claim 10, wherein the first pivoting shaft is fixedly connected to the second connection member via a fastener.

12. The cleaning device according to claim 10, wherein the first pivoting shaft is integrally formed with the second connection member, and passes through the first connection member to be rotatably connected with the first connection member.

13. The cleaning device according to claim 10, wherein the first connection member is provided with a depression in a position corresponding to the first pivoting member, and the connection mechanism further comprises a cover detachably covering the depression.

14. The cleaning device according to claim 13, wherein an outer surface of the cover is flush with an outer surface of the first connection member.

15. The cleaning device according to claim 1, wherein the first connection member and the second connection member are both of hollow structures, the first passage is disposed between the first connection member and the second connection member, and the second passage passes through the first connection member and the second connection member.

* * * * *